US006253856B1

(12) United States Patent
Ingram et al.

(10) Patent No.: US 6,253,856 B1
(45) Date of Patent: Jul. 3, 2001

(54) PACK-OFF SYSTEM

(75) Inventors: Gary Duron Ingram, Richmond; Corey Eugene Hoffman, Spring, both of TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/435,388

(22) Filed: Nov. 6, 1999

(51) Int. Cl.[7] ..... E21B 33/126
(52) U.S. Cl. ..... 166/374; 166/191
(58) Field of Search ..... 166/374, 373, 166/120, 387, 187, 191

(56) References Cited

U.S. PATENT DOCUMENTS

| | | | |
|---|---|---|---|
| 2,177,601 | 10/1939 | Smith . | |
| 3,035,639 | 5/1962 | Brown et al. . | |
| 3,044,553 | 7/1962 | Bradley . | |
| 3,270,814 | 9/1966 | Richardson et al. . | |
| 3,436,084 | 4/1969 | Courter . | |
| 3,437,142 | 4/1969 | Conover . | |
| 3,503,249 | 3/1970 | Dumond . | |
| 3,542,127 | 11/1970 | Malone . | |
| 3,749,166 | 7/1973 | Young . | |
| 3,797,572 | 3/1974 | Mignotte . | |
| 3,876,000 | 4/1975 | Nutter . | |
| 3,876,003 | 4/1975 | Kisling, III . | |
| 4,216,827 | 8/1980 | Crowe . | |
| 4,224,987 | 9/1980 | Allen . | |
| 4,279,306 | 7/1981 | Weitz | 166/312 |
| 4,421,165 | 12/1983 | Szarka . | |
| 4,482,086 | 11/1984 | Wagner et al. . | |
| 4,485,876 | 12/1984 | Speller | 166/363 |
| 4,492,383 | 1/1985 | Wood . | |
| 4,499,947 | 2/1985 | Zsoka et al. . | |
| 4,519,456 | 5/1985 | Cochran | 166/312 |
| 4,569,396 | 2/1986 | Brisco | 166/305.1 |
| 4,840,231 | 6/1989 | Berzin et al. . | |
| 4,869,324 | 9/1989 | Holder . | |
| 4,934,460 | 6/1990 | Coronado | 166/386 |
| 5,000,265 | 3/1991 | Pleasants et al. . | |
| 5,044,444 | 9/1991 | Coronado . | |
| 5,046,557 | 9/1991 | Manderscheid . | |
| 5,146,994 | 9/1992 | Pleasants et al. . | |
| 5,988,285 | 11/1999 | Tucker et al. . | |
| 5,992,524 | 11/1999 | Graham . | |

FOREIGN PATENT DOCUMENTS

| | | | |
|---|---|---|---|
| 2292400 | 8/1994 | (GB) | E21B/33/1295 |

OTHER PUBLICATIONS

Flow Control Equipment, Baker, Composite Catalog 1974–75, vol. 1, pp. 446, 447.
Otis Completion Systems, Otis, Composite Catalog 1984–85, vol. 4, p. 6232.
Otis Wireline Production Equipment, Otis, Composite Catalog 1974–75, vol. 1, p. 3973.
1987–1988 Catalogue, Jani Int'l, Inc., pp. 75, 76, 82, 84.
Flow Control Systems, Baker Packers 1984–85 Catalog, pp. 608–611.
PCT/GB00/03889; In'tl Search Report; PCT Counterpart of this application 09/435,388.

*Primary Examiner*—Frank Tsay
(74) *Attorney, Agent, or Firm*—Guy McClung

(57) ABSTRACT

A pack-off system for packing off an area of interest in a wellbore, the pack-off system comprising a body, two spaced-apart selectively settable packing elements on the body for sealing off the area of interest, selectively actuatable setting apparatus connected to the body for selectively setting the two spaced-apart selectively settable packing elements, the selectively actuatable setting apparatus actuatable by fluid under pressure introduced into the pack-off system. A method for packing off an area of interest in a wellbore, the method including installing a pack-off system as described herein in the wellbore to pack-off the area of interest. Such a method may also include flowing treatment fluid from the pack-off system to an area of interest in an earth formation and/or adjacent a wellbore in the earth.

23 Claims, 6 Drawing Sheets

PACK-OFF SYSTEM

BACKGROUND OF THE INVENTION

1. Field of the Invention

This invention is related to wellbore packers and methods of their use; in certain particular aspects, to an hydraulically set wellbore straddle pack-off system and methods of its use; and in one particular aspect to such a system that is set and released without mechanically pulling or pushing on the system.

2. Description of Related Art

Often in wellbore operations it is desirable to "straddle" an area of interest in a wellbore, e.g. a formation or part thereof or a zone or location in a wellbore packing off the wellbore above and below the area of interest. Typically a packer is set above and another packer is set below the area of interest.

A variety of prior art straddle pack-off tools are available which include two selectively-settable spaced-apart packing elements. Several such prior art tools use a piston or pistons movable in response to hydraulic pressure to actuate packer element setting apparatus. Debris or other material can block or clog the piston apparatus, inhibiting or preventing setting of the packer elements (and preventing un-setting/release of the packer elements.

Various prior art tools have no emergency pressure release feature, useful, e.g. when a formation goes to vacuum.

Many prior art pack-off systems require the application of tension and/or compression to parts of the system (mechanical pulling and/or pushing), to actuate parts of the system. Such systems cannot be used on coiled tubing.

There has long been a need for an efficient and effective wellbore straddle pack-off system. There has long been a need for such a system without a piston that could be clogged by debris. There has long been a need for such a system which can be selectively released in an emergency situation. There has long been a need for such a system which does not require pulling or pushing for actuation. There has long been a need for such a system useful on coiled tubing.

SUMMARY OF THE PRESENT INVENTION

The present invention, in certain aspects, discloses a wellbore pack-off system with selectively-settable spaced-apart packing elements. The packing elements are on a tubular member that is interconnected with one or more additional tubular members so that when fluid (e.g introduced to the pack-off system and/or pumped under pressure, e.g. from an earth surface pumping apparatus or from an apparatus within the wellbore) is applied to the tubular members, they telescope apart. Then a movable tubular setting sleeve is moved to set the packing elements. Such a system may be used in an open hole or in a tubular string (tubing, casing, liner, etc.) in a wellbore. It can be set, e.g. (but not limited to): across a formation or part thereof; across a zone of interest; within a gravel pack screen; across a sliding sleeve; and across two previously-set packers.

In certain embodiments such a system is used with tubulars with alignable orifice(s) and exit port(s) or with an injection sub to treat a formation. The tubulars or injection sub may be any suitable length so that the spaced-apart packers, when set, effectively isolate the area of interest between them. Treating fluid is pumped through one or more orifices and/or exit ports into the area of interest in a formation.

A system according to the present invention may be located, set, and used in a wellbore operation (e.g., but not limited to, formation treatment and setting of an external casing packer) and then released and moved to another location in a wellbore without retrieval to the surface.

In certain aspects, fluid under pressure flowing into the system following setting of the packing elements pushes against parts of the system which "boost" the packing elements, enhancing their sealing effect.

In certain aspects a selectively acutatable flow control apparatus or valve is used in a system according to the present invention to provide for the release of fluid under pressure from within the system to equalize pressures inside and outside the system so the packing elements can be selectively released.

Such systems may be run on any suitable tubular string, e.g., coiled tubing, fiber optic line system, slick line, electrically conductive wireline, electrically non-conductive wireline, casing, or tubing.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide new, useful, unique, efficient, nonobvious wellbore pack-off systems and methods of their use;

- Such systems without pistons involved in the setting of packing elements, pistons which could be clogged or blocked by debris;
- Such system useful in formation treatment operations;
- Such systems with a pressure equalizing valve to permit selective release of the packing elements;
- Such systems which are releasable and movable within a bore without the necessity of retrieval to a top of the bore;
- Such systems which do not require mechanical pushing or pulling on the system to set and release packer elements; and
- Such systems which boost the sealing effect of packing elements.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
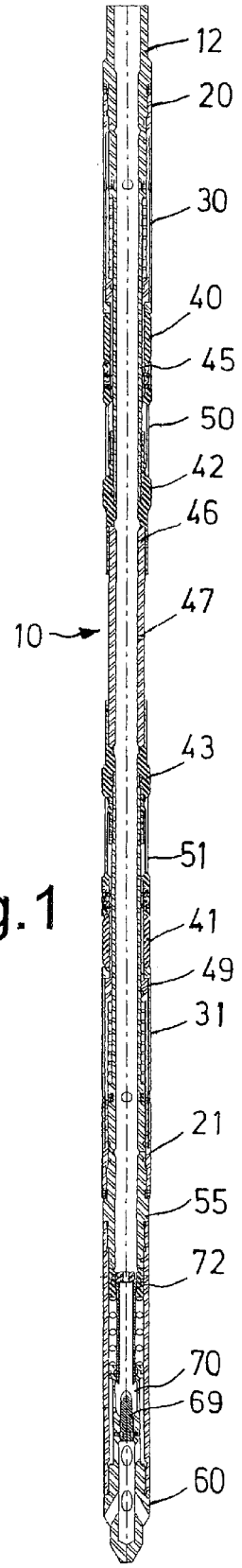
FIG. 1 is a side cross-section view of a generally cylindrical system according to the present invention in a "run-in" configuration.

Referring now to FIG. 1 and FIGS. 1A–1C, a system 10 according to the present invention has a generally cylindrical top sub 12 with a flow bore 11 therethrough from top to bottom and to which is threadedly connected a top pack-off mandrel 20. An o-ring 13 seals a sub/mandrel interface and set screws 14 prevent unthreading of the top pack-off mandrel 20 from the top sub 12.

Figure 1A:
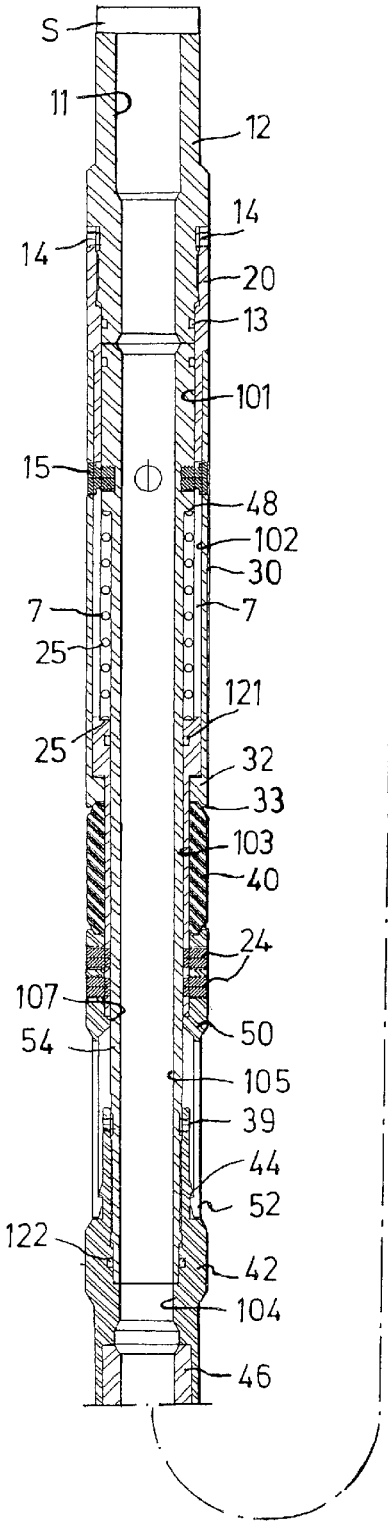
FIGS. 1A, 1B and 1C present enlargements of portions of the system of FIG. 1A.
Figure 1B:
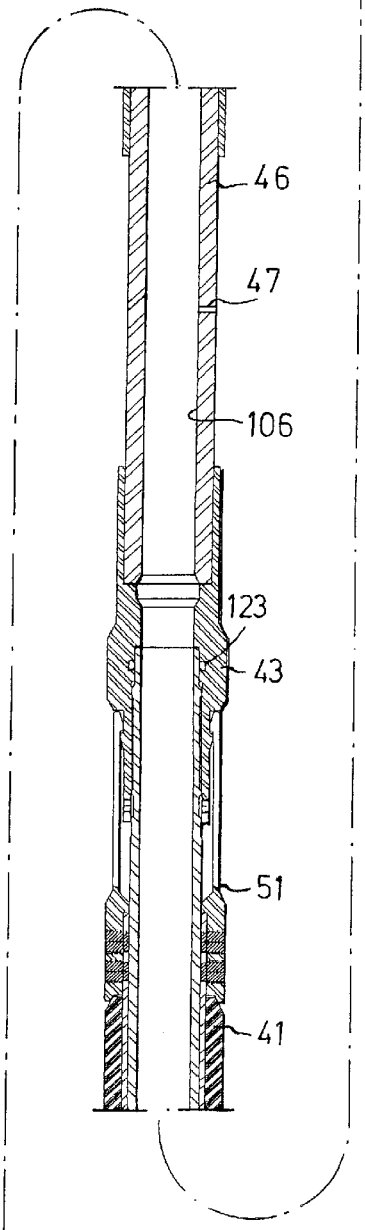
Figure 1C:
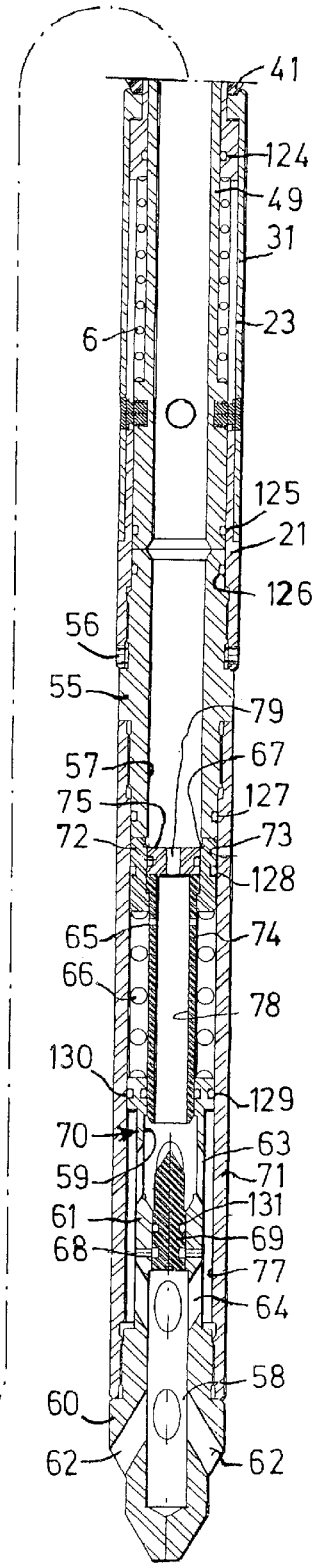

The top sub 12 is connected to a lower end of any suitable tubular string (tubing, casing, etc.), working string, or coiled tubing S, shown schematically in FIG. 1A, for use in a wellbore or within a bore in a tubular string in a wellbore.

Four spaced-apart crossover pins 15 (any suitable number of pins may be used) secure together a top setting sleeve 30 and a top body 45. The pins 15 extend through slots 22 in the top pack-off mandrel 20 so that the setting sleeve 30 and top body 45 are movable together with respect to the top pack-off mandrel 20 while the pins move in the slots.

A top spring 7 has a lower end that abuts a shoulder 25 of the top pack-off mandrel 20 and an upper end that abuts a shoulder 48 of the top body 45. Initially the top spring 7 urges apart the top body and the top pack-off mandrel 20, thus maintaining a top latch 50 (described below) in a latched position thereby preventing setting of a top packing element 40 (described below).

The top setting sleeve 30 has an end 32 with a lip 33 that abuts a top end of the top packing element 40. The top packing element 40 is positioned around a lower end of the top pack-off mandrel 20. The packing elements 40, 41 may be made of any suitable resilient material, including but not limited to, any suitable elastomeric or polymeric material, and any suitable known prior art element may be used.

The top latch 50 has a top end secured to a lower end of the top pack-off mandrel 20 by pins 24. The top latch 50 has a plurality of spaced-apart collet fingers 52 that initially latch onto a shoulder 44 of an upper bottom sub 42. Set screws 39 secure the bottom sub 42 to a lower end of the top body 45. The top end of the bottom sub 42 is also threadedly connected to the lower end of the top body 45. An o-ring 39 seals a top body/bottom sub interface.

An injection sub 46 has a top end threadedly connected to a lower end of the upper bottom sub 42 and a lower end threadedly connected to a top end of a lower bottom sub 43. An orifice 47 permits fluid flow between the interior of the injection sub 46 and space external to the system 10. Any number of orifices may be used.

Items 20, 30, 40 42, 45, 46 and 50 are generally cylindrical in shape, each with a top-to-bottom bore 101, 102, 103, 104, 105, 106, and 107, respectively, therethrough.

The various parts from the lower bottom sub 43 to a bottom pack off mandrel 21 mirror the upper parts in structure and function; i.e., the following parts correspond to each other: 6–7; 20–21; 22–23; 30–31; 40–41; 42–43; 45–49; 50–51. A lower end of the bottom pack-off mandrel 21 is threadedly connected to an upper end of a crossover sub 55 and set screws 56 secure the bottom pack-off mandrel 21 to the crossover sub 55. The crossover sub 55 has a top-to-bottom bore 57 therethrough.

O-rings with the following numerals seal the indicated interfaces: 121, pack-off mandrel 20/top body 45; 122, bottom sub 42/top body 45; 123, bottom sub 43/bottom body 46; 124, bottom pack-off mandrel 21/bottom body 46; 125, bottom body 46/bottom pack-off mandrel 21; 126, crossover sub 55/bottom pack-off mandrel 21; and 127, crossover sub 55/valve housing 71.

A flow activated shut-off valve assembly 70 has a housing 71 with a top-to-bottom bore 77 therethrough. A nozzle 60 is threadedly connected to a lower end of the valve housing 71. A piston 72 is movably disposed in the bore 77. The piston 72 has a piston body 73, a piston member 74 with an upper end within the piston body 73, and a piston orifice member 75 with a top-to-bottom opening 79 also within the piston body 73. A locking ring 67 holds the piston orifice member 75 and piston member 74 in place. Port 65 provides for pressure equalization between the exterior and interior of the piston member 74.

A spring 66 has an upper end that abuts a lower end of the piston body 73 and a lower end that abuts a top end of the nozzle 60. Initially the spring 66 urges the piston 72 upwardly to maintain the piston 72 in the position shown in FIGS. 1 and 1C.

The nozzle 60 has outlet ports 62, inner ports 63, and inner ports 64. The inner ports 63, 64 extend through a wall 61 of the nozzle 60. In the position of the piston 72 shown in FIGS. 1 and 1C, fluid can flow: from the interior of the system 10; down to an orifice 79 through the piston orifice member 75; through a bore 78 of the piston member 74; into a bore 59 of the nozzle 60; out through the inner ports 63 into a space between the exterior of the wall 61 and an interior of the valve housing 71; in through the inner ports 64 into a plug chamber 58 of the nozzle 60; and then out through the outlet ports 62.

Initially a diverter plug 69 is secured to the nozzle 60 by shear screws 68 so that it does not affect the fluid flow path described in the preceding paragraph and prevents flow directly through the nozzle 60.

O-rings with the following numerals seal the indicated interfaces: 128, piston body/valve housing; 129, nozzle/valve housing; 130, nozzle/piston member; and 131, diverter plug/nozzle.

The cross sub 55, valve housing 71, piston body 73, piston member 74, and piston orifice member 75 are generally cylindrical.

Instead of the valve assembly 70, optionally a bull plug may be installed at the end of the system 10. Also, optionally a ball-drop circulation sub may be installed above the crossover and the valve assembly. So that dropping a ball to the ball-drop circulation sub opens to fluid flow permitting pressure equalization above and below the sub and, in one aspect of such a system, the valve assembly 70 can be deleted.

Figure 2:
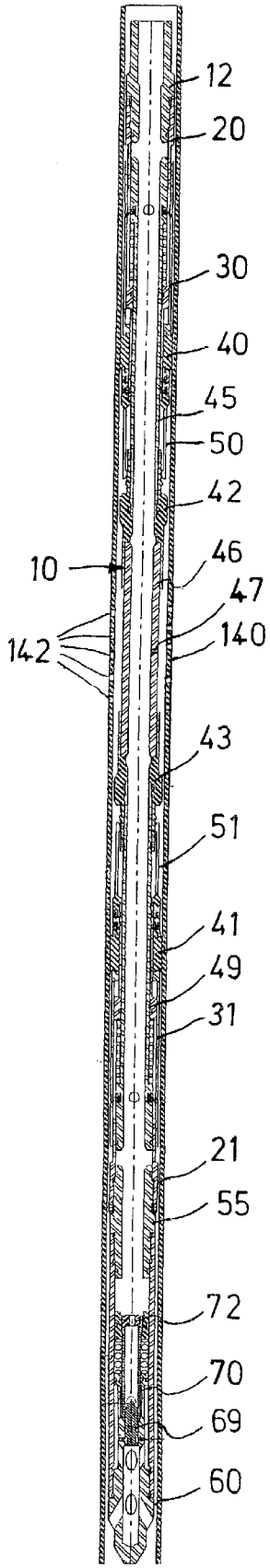
FIG. 2 shows the system of FIG. 1A in a packed-off position with packer elements set in a string of tubing.

In one particular method of operation of a system 10 according to the present invention (or a system 200), the system is run into a tubular string in a wellbore, e.g. like the tubing string 140, FIG. 2. Using any suitable known locator tool, device, system or apparatus, the system 10 is positioned at a desired location in the tubing string 140. In one particular aspect, the tubing 140 (and any additional strings in the wellbore outside the tubing 140, e.g. additional string(s) of tubing or casing that are also perforated) have been perforated at this location to allow production from an earth formation at this location and the packing elements 40, 41 are positioned so that the formation of interest is between them. The distance between the packing elements can be adjusted, e.g., by using an injection sub of a desired length and/or by connecting additional tubulars to one or both ends of the injection sub.

Once the system 10 has been located at the desired location in the wellbore within the tubing string 140, fluid under pressure is pumped from the surface at a rate to achieve sufficient pressure within the system 10 to force the piston 72 down closing off the fluid flow path out through the nozzle 60. Pressure then increases to pull the collet fingers 52 over the corresponding shoulders on the upper and lower bottom subs 42, 43, thereby forcing the various parts to telescope apart and freeing the setting sleeves 30, 31 for movement with respect to their corresponding pack-off mandrels. The top setting sleeve 30 pushes down to set the top packing element 40 and the bottom latch 51 is pulled down against the bottom packing element 41 pushing it against the bottom setting sleeve 31 to set the bottom packing element as shown in FIG. 2.

For operations with a system as depicted in FIGS. 1 and 2 and as described above, in one embodiment the system 10 is connected at the lower end of a string of coiled tubing. Coiled tubing is useful in such operations because, among other things, coiled tubing can be moved relatively quickly within a wellbore, coiled tubing can be moved into a wellbore that is subjected to wellbore pressure within the wellbore without having to kill the well; and systems according to the present invention do not require the application of mechanical tension or compression.

Once the packing elements 40, 41, are set, as in FIG. 2, fluid for treating the formation is pumped down to the injection sub 46, out through the orifice 47, through perforations 142 in the tubing 140 (and through similar perforations in any other string within the wellbore exterior to the tubing 140) and into the formation. The pumping of this fluid under pressure also boosts the sealing effect of the packing elements 40, 41 since a portion of the pumped fluid flows within the tubing string 140, past the bottom subs 42, 43, and forces the latches 50, 51 against the packing elements 40, 41, thereby increasing ("boosting") the sealing effect of the packing elements.

Following delivery of the desired fluid and the desired amount of fluid to the formation, the system 10 can be moved to another location within the wellbore by stopping the pumping of fluid, which allows the springs 6, 7, to re-latch the latches 50, 51 resulting in un-setting and release of the packing elements 40, 41. Then the system 10 can be relocated and the packing elements set again as described above for further operations at the new location.

Any suitable fluid may be injected into a formation with a system according to the present invention, (such as the systems 10 or 200) including, but not limited to water, and/or chemicals. In certain aspects, water is first pumped to insure that a formation will take fluid and then a treating fluid is pumped, e.g. an acidizing fluid or a gel and/or polymer treatment fluid.

A system according to the present invention, e.g. such as the system 10 or system 200, is also useful for inflating an external casing packer on casing in a cased wellbore. The system 10 is run into the casing, knocking off the packer's knock-off device for selective flow of fluid into the external casing packer. Then the system 10 is activated as described above and fluid under pressure flowing through the orifice(s) 47 inflates the external casing packer.

In one aspect, an unloader is used with any system according to the present invention, including but not limited to a system 10 or a system 200, e.g., but not limited to, an unloader as disclosed in pending U.S. application Ser. No. 09/411,718 entitled "Packer System" naming Ingram, Hoffman, Haugen and Beeman as co-inventors filed Oct. 2, 1999, co-owned with the present invention and incorporated here fully for all purposes. In a situation in which an unloader becomes clogged and fluid pressure cannot be relieved within the system 10 to release the packing elements, fluid is pumped from the surface into the system 10 at a sufficiently high pressure (e.g. 5000 psi) to shear the shear screws 68, freeing the diverter plug 69. The diverter plug 69 is then pumped into the plug chamber 58, thus opening the nozzle 60 for the exit flow of fluid from within the system 10 and out through the outlet ports 62. With this release of fluid, the packing elements 40, 41 are released and the system 10 can be moved and/or retrieved.

Similarly if fluid at relatively high pressure is being held either below the system 10 in a wellbore or between the packing elements 40, 41, the diverter plug 69 can be pumped into the plug chamber 58 to equalize pressure between the exterior of the system 10 and its interior. In formation treating operations when fluid injection ceases and the formation will take no more fluid, a hydrostatic head of high pressure fluid may be created above the system 10. Again, by pumping fluid under pressure through the system, the shear screws 68 are sheared and the diverter plug is pumped into the plug chamber 58 allowing fluid flow out the nozzle 60 for pressure equalization and subsequent system retrieval.

A system according to the present invention (including any such system disclosed herein, including, but not limited to a system 10 or a system 200) may be set within a gravel pack screen located in an earth wellbore adjacent a formation or part thereof to pack-off an area of interest and then perform the steps of a formation treatment operation, e.g. the injection into the formation (or part thereof) of treatment fluid as described above. Similarly, a system according to the present invention may be set across a sliding sleeve to perform such operation; or used with each packing element of the system set within a packer bore of the one of two spaced-apart packers previously set in a bore.

Figures 3A, 3B, 3C:
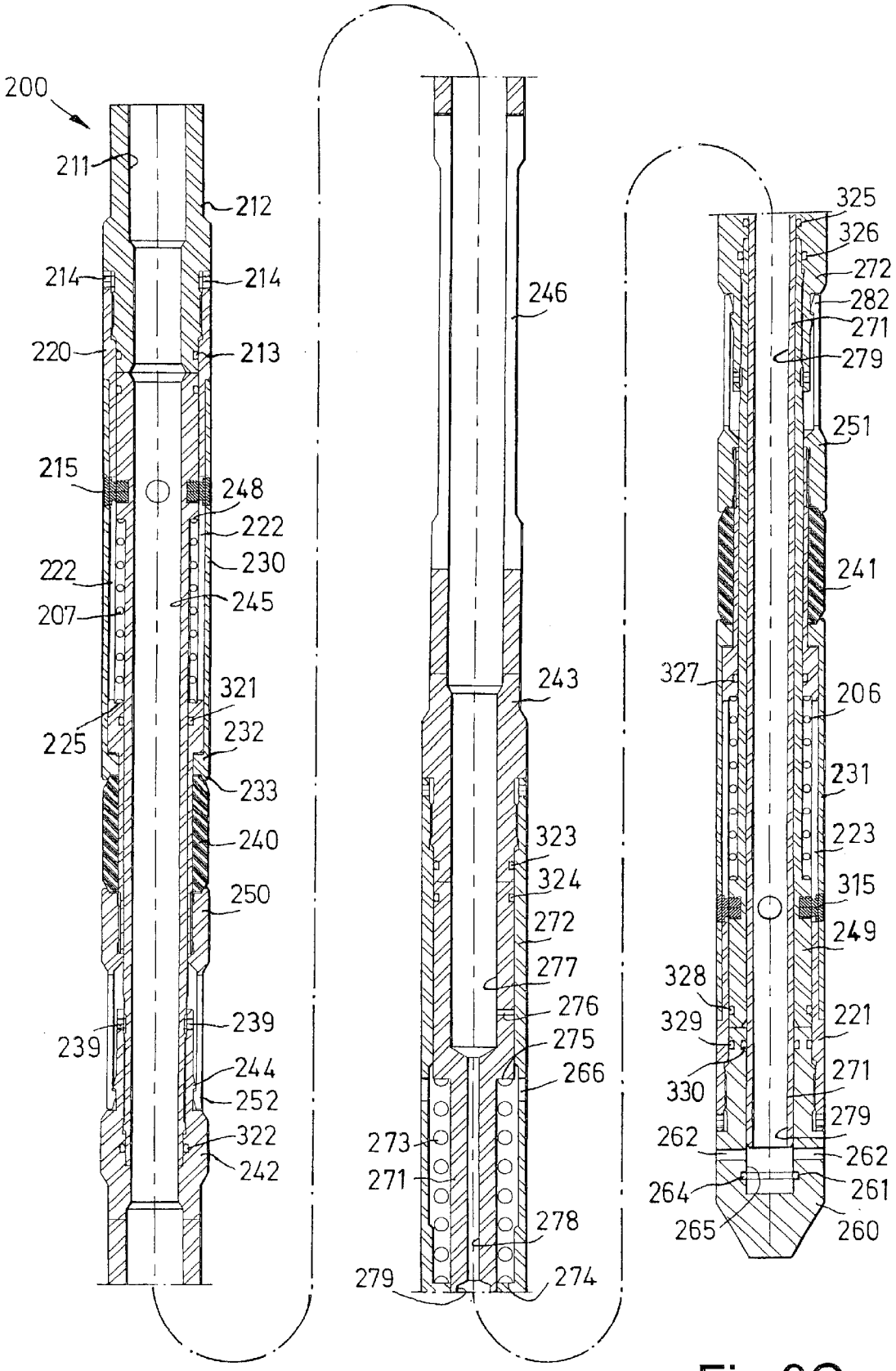
FIGS. 3A–3C are side cross-section views of a system according to the present invention.

Referring now to FIGS. 3A–3C, a system 200 according to the present invention has a generally cylindrical top sub 212 with a flow bore 211 therethrough from top to bottom and to which is threadedly connected a top pack-off mandrel 220. An o-ring 213 seals a sub/mandrel interface and set screws 214 prevent unthreading of the top pack-off mandrel 220 from the top sub 212.

The top sub 212 is connected to a lower end of any suitable tubular string (tubing, casing, etc.), working string, or coiled tubing (e.g., as shown schematically as string S in FIG. 1A), for use in a wellbore or within a bore in a tubular string in a wellbore.

Four spaced-apart crossover pins 215 secure together a top setting sleeve 230 and a top body 245. The pins 215 extend through slots 222 in the top pack-off mandrel 220 so that the setting sleeve 230 and top body 245 are movable together with respect to the top pack-off mandrel 220 while the pins move in the slots.

A top spring 207 has a lower end that abuts a shoulder 225 of the top pack-off mandrel 220 and an upper end that abuts a shoulder 248 of the top body 245. Initially the top spring 207 urges apart the top body and the top pack-off mandrel 220, thus maintaining a top latch 250 (described below) in a latched position thereby preventing setting of a top packing element 240 (described below).

The top setting sleeve 230 has an end 232 with a lip 233 that abuts a top end of the top packing element 240. The top packing element 240 is positioned around a lower end of the top pack-off mandrel 220. The packing element 240 (and element 241) may be made of material as described above for the element 40.

The top latch 250 has a top end threadedly secured to a lower end of the top pack-off mandrel 220. The top latch 250 has a plurality of spaced-apart collet fingers 252 that initially latch onto a shoulder 244 of an upper bottom sub 242. Set screws 239 secure the bottom sub 242 to a lower end of the top body 245. The top end of the bottom sub 242 is also threadedly connected to the lower end of the top body 245. An o-ring 239 seals a top body/bottom sub interface.

An optional spacer tube 246 has a top end connected to a lower end of the upper bottom sub 242. The spacer tube 246 has a lower end connected to a top end of a lower bottom sub 243.

Items 220, 230, 240 242, 245, 246 and 250 are generally cylindrical in shape, each with a top-to-bottom bore therethrough.

The various parts from the lower bottom sub 243 to a bottom pack off mandrel 221 mirror the upper parts in structure and function; i.e., the following parts correspond to each other: 215–315; 220–221; 222–223; 230–231; 240–241; 242–243; 245–249; 250–251; 252–282. A lower end of the bottom pack-off mandrel 221 is threadedly connected to a nozzle 260.

O-rings with the numerals 321–330 seal various interfaces.

A flow activated shut-off assembly 270 has a shut off sleeve 271 with a top-to-bottom bore 277, 278, 279 therethrough. The nozzle 260 receives a lower end of the sleeve 271. The sleeve 271 is movable within a housing 272 whose upper end is connected to the lower bottom sub 243. The lower end of the sleeve 271 moves within the nozzle 260. A spring 273 has a lower end that abuts a shoulder 274 of the housing 272 and an upper end that abuts a shoulder 275 of the shut-off sleeve 271. An orifice 276 extends through the sleeve 271 and a port 266 extends through the housing 272.

The spring 273 urges the sleeve 271 upwardly to maintain the sleeve 271 initially in the position shown in FIG. 3C.

The nozzle 260 has outlet ports 262 and a seal ring 264 in a recess 261 of the nozzle 260. In the position of the sleeve 271 shown in FIG. 3C fluid can flow: from the interior of the system 200; down to the bores 277–279; into a bore 265 of the nozzle 260; and out through the ports 262 into a space between the exterior of the system 200 and an interior of a bore or wellbore in which the system 200 is located.

The sleeve 271 and housing 272 are generally cylindrical.

In one particular method of operation of a system 200 according to the present invention, the system is run into a tubular string in a wellbore (e.g. like the tubing string 140, FIG. 2). Using any suitable known locator tool, device, system or apparatus, the system 200 is positioned at a desired location in the string. In one particular aspect, the tubing (and any additional strings in the wellbore therearound) has been perforated at this location to allow production from an earth formation F through which the wellbore W extends at this location and the packing elements 240, 241 are positioned so that the formation of interest or part thereof is between them. The distance between the packing elements can be adjusted, e.g., by using a spacer tube of a desired length and/or by connecting additional tubulars to one or both ends of the spacer tube.

Figure 3D:
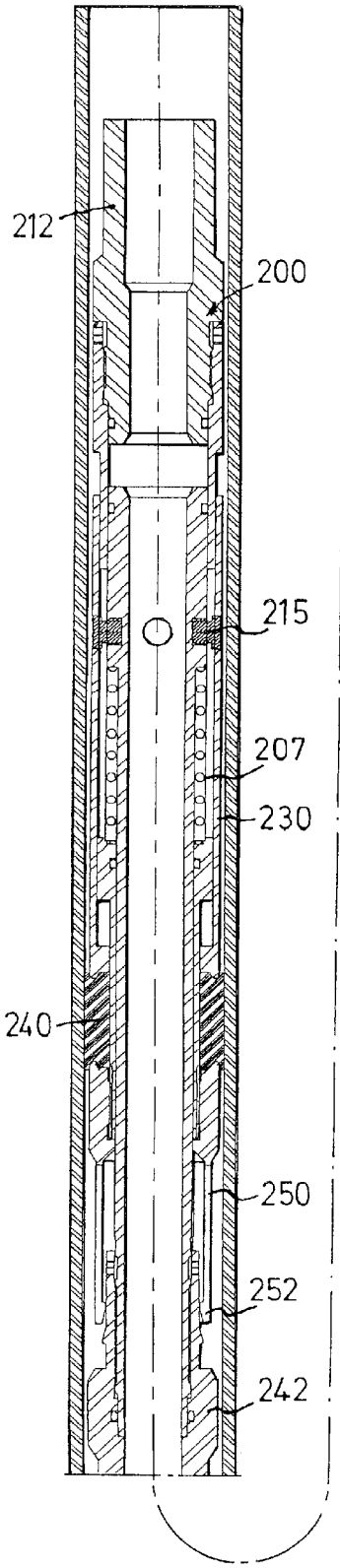
FIGS. 3D–3F show the system of FIGS. 3A–3C in a packed-off position with packer elements set in a string of tubing.
Figure 3E:
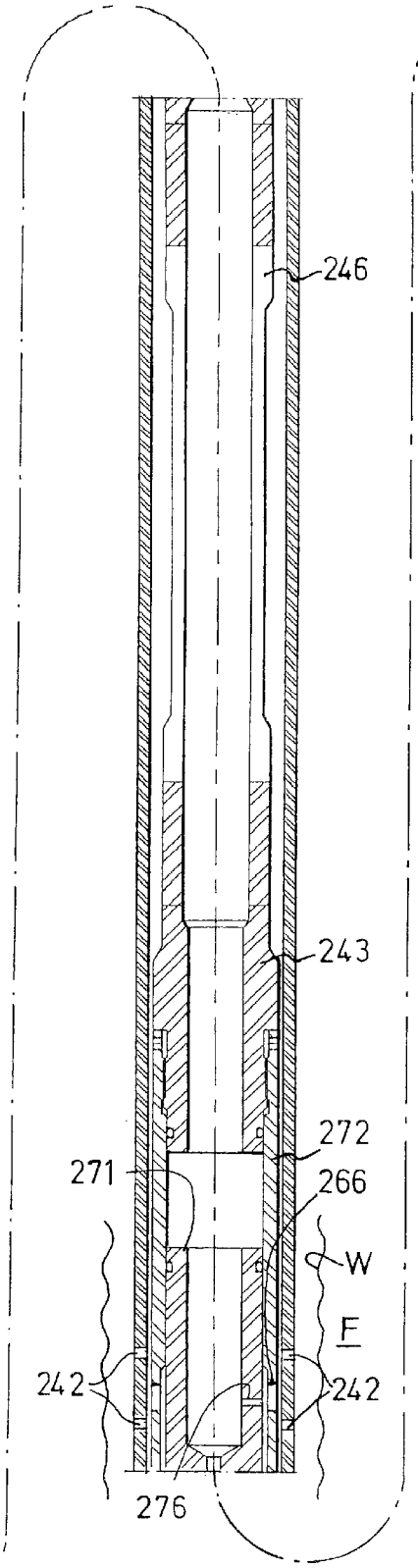
Figure 3F:
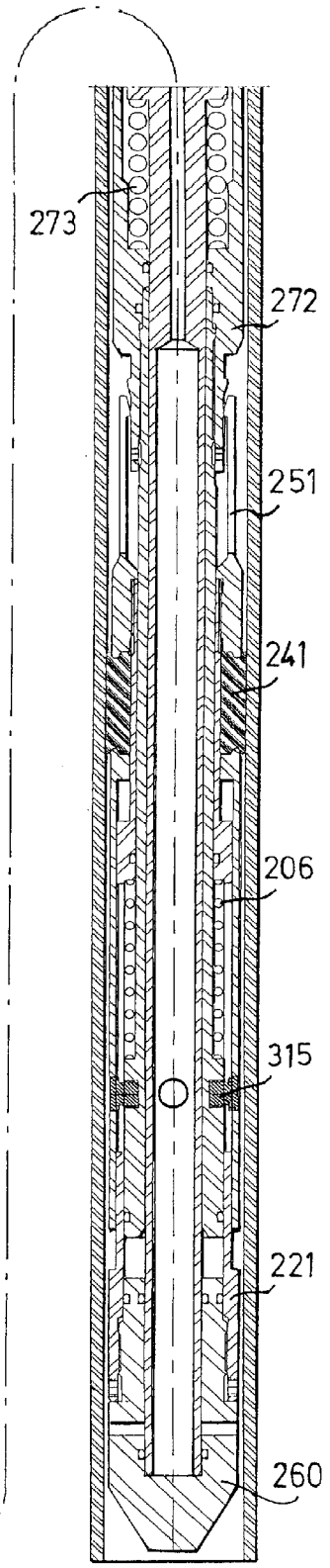

Once the system 200 has been located at the desired location in the wellbore within the string fluid under pressure is pumped from the surface at a rate to achieve sufficient pressure within the system 200 to force the sleeve 271 down closing off the fluid flow path out through the nozzle 260 (see FIG. 3F). Pressure then increases to pull the collet fingers 252, 282 over the corresponding shoulders on the upper and lower bottom subs 242, 243, thereby forcing the parts above the upper bottom sub and below the housing 272 to telescope apart from the spacer tube and freeing the setting sleeves 230, 231 for movement with respect to their corresponding pack-off mandrels. The top setting sleeve 230 pushes down to set the top packing element 240 and the bottom latch 251 is pulled down against the bottom packing element 241 pushing it against the bottom setting sleeve 231 to set the bottom packing element as shown in FIGS. 3D, 3F.

For operations with a system as depicted in FIGS. 3A–3F and as described above, in one embodiment the system 200 is connected at the lower end of a string of coiled tubing.

Once the packing elements 240, 241, are set, fluid for treating the formation is pumped down to the orifice 276 and port 266 (aligned as in FIG. 3E), through perforations 242 in the tubing 240 (and through similar perforations in any other string within the wellbore therearound) and into the formation. The pumping of this fluid under pressure also boosts the sealing effect of the packing elements 240, 241 since a portion of the pumped fluid flows to force the latches 250, 251 against the packing elements thereby increasing ("boosting") the sealing effect of the packing elements.

Following delivery of the desired fluid and the desired amount of fluid to the formation, the system 200 can be moved to another location within the wellbore by ceasing pumping of fluid, which allows the springs 206, 207, to re-latch the latches 250, 251 resulting in un-setting and release of the packing elements 240, 241. Then the system 200 can be relocated and the packing elements set again as described above for further operations at the new location. Any suitable fluid may be injected into a formation with a system 200 according to the present invention.

In one aspect, an unloader is used with any system 200, e.g., but not limited to, an unloader as disclosed in pending U.S. application Ser. No. 09/411,718 mentioned above. When it is desired to equalize pressure inside and outside the system 200, e.g. but not limited to an emergency situation, the level at which fluid is pumped to the sleeve 271 is reduced so that the spring 273 pushes the sleeve 271 up to the position of FIG. 3C. With pressure inside and outside the system equalized, the packing elements are released and the system can then be retrieved to the surface or relocated in the bore for further operations.

Figure 4A:
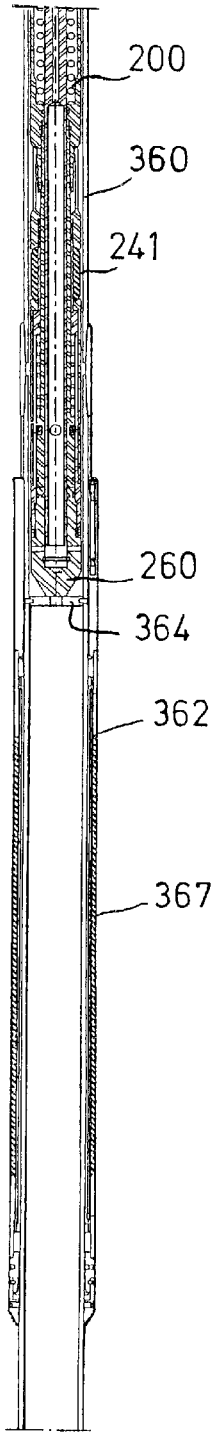
FIG. 4A is a side cross-section view of a step in a method for inflating an external casing packer using a system according to the present invention.
Figure 4B:
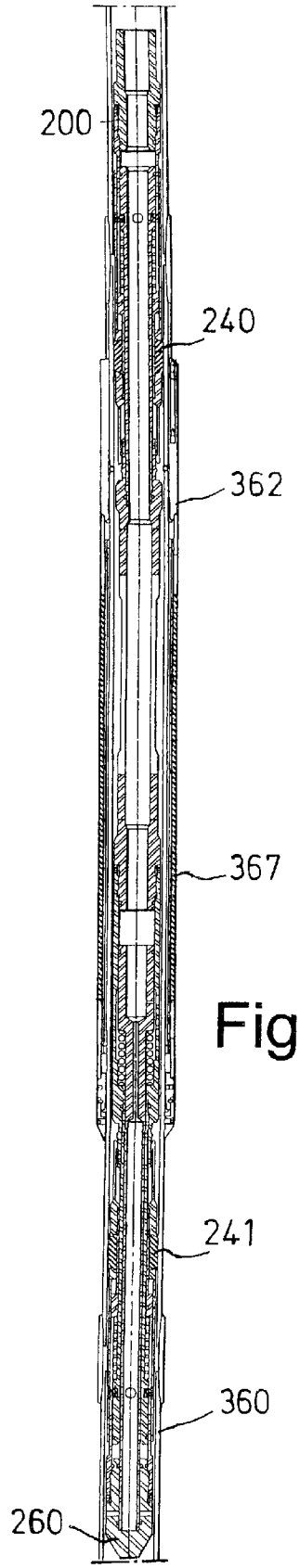
FIG. 4B shows the system of FIG. 4A in place with respect to the external casing packer.

FIG. 4A shows a system 200 being moved within a casing string 360 to a location of an external casing packer 362 with a packing element 367. (Packer 362 represents any known external casing packer.) The nozzle 260 of the system 200 has contacted a knockoff device 364 which initially prevents fluid from flowing from within the casing (and from within a system like the system 200) to inflate the packer's packing element 367. As shown in FIG. 4B, the system 200 has been located so that the packing elements 240, 241 isolate ("pack off") the external casing packer. The knock-off device 364 has been knocked-off so that fluid pumped to and out from the system 200 will inflate the packing element 367. It is within the scope of this invention to knock off the device 364 with other apparatus prior to running in the system 200, or this can be done prior to installing the packer 362 in a wellbore.

Figure 5A:
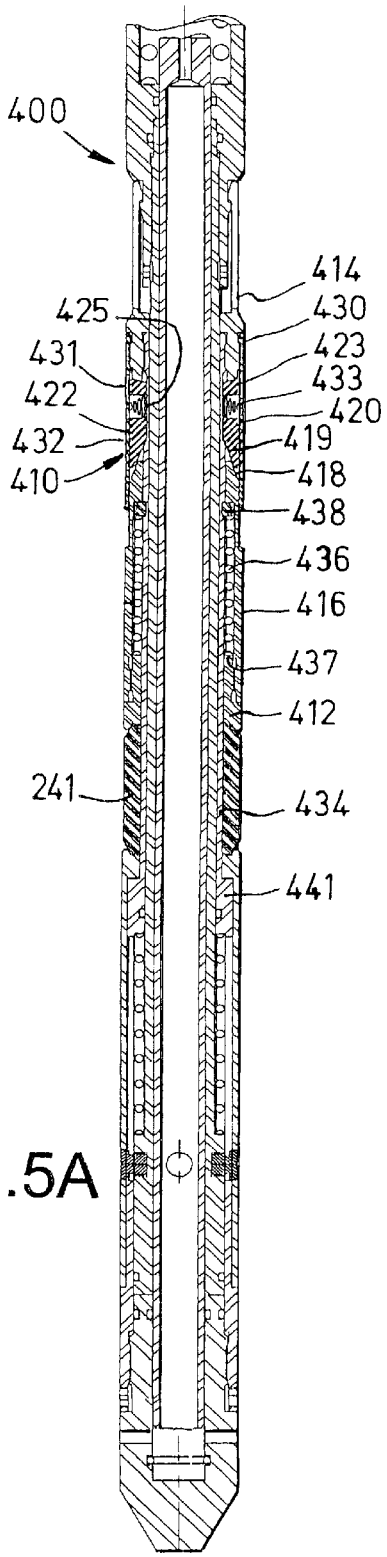
FIG. 5A is a side cross-section view of a system according to the present invention.

FIG. 5A shows an alternative embodiment 400 of the system 200 which incorporates a slip-setting mechanism 410 above the lower packing element 241. (Optionally, such a slip-setting mechanism may be employed above the upper packing element 240.) The slip-setting mechanism 410 is interposed between a latch 414 (similar to the latch 251) and a lower sleeve end 412 (which is like the lower end of the latch 251, FIG. 3C). The lower sleeve end 412 is threadedly connected to an outer sleeve 416 which has an upper tapered end 418. The upper tapered end initially abuts a corresponding lower tapered end 419 of a plurality of spaced-apart slips 420 (two, three, four or more may be used), each, preferably, with a toothed outer surface 422 (although any suitable known slip or gripping element may be used). Each slip 420 has an upper slip portion 423 and a mid-portion 425.

Figure 5B:
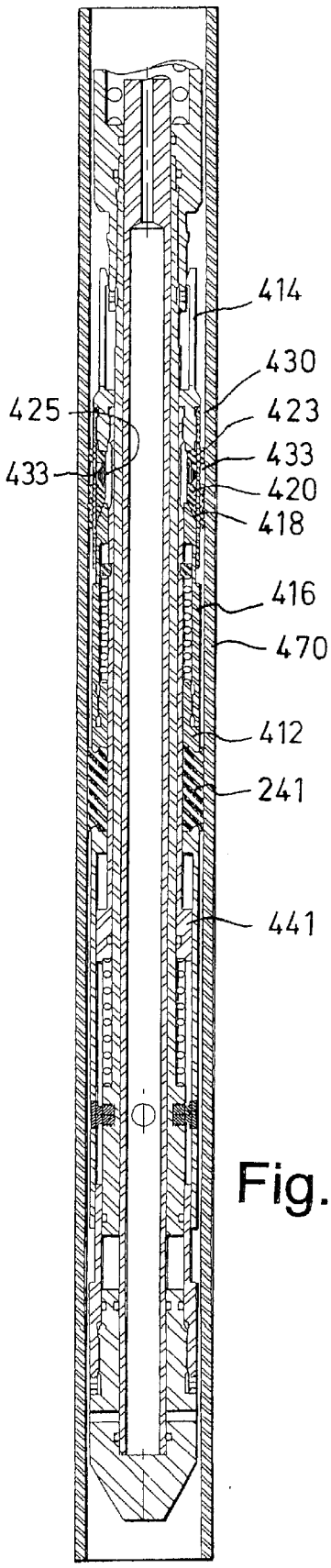
FIG. 5B shows the system of FIG. 5A in place in a tubing string.

A housing 430 surrounds the slip-setting mechanism 410 and has windows 431, 432 through which the slips 420 may project. Springs 433 between the housing 430 and the slip mid-portions 425 urge the slips toward a pack off mandrel 441, urging the slips 420 inwardly and initially holding the slips 420 in the position shown in FIG. 5A. A stop ring 438 is secured to the pack off mandrel 441. A spring 436 that abuts a top 437 of the lower sleeve end 412 and a lower surface of the stop ring 438 urges the lower sleeve end 412 and the outer sleeve 416 downwardly, i.e., to a position as shown in FIG. 5A. As shown in FIG. 5B, the pack off mandrel 441 and slip-setting mechanism 410 have moved downwardly, forcing the slips 420 against the upper tapered end 418 of the outer sleeve 416 and thus outwardly through the housing windows 431, 432 and into setting engagement with an interior surface of a tubing 470 (or bore, casing, etc.) in which the system is located. The spring 436 has been compressed. By ceasing the pumping of fluid to the system 400, and moving the system downwardly the slips 420 are released and the system is re-latched, as described above for the system 200.

In one method according to the present invention, by sizing the packing elements 240, 241 with the upper element larger than the lower element, the system 200 can be disposed in a wellbore so that the upper packing element is in a first tubular string having a first inner diameter and the lower packing element is in a second tubular string connected to and below the first tubular string, the second tubular string having an inner diameter less than that of the first tubular string.

Alternatively, in one aspect, the upper packing element 240 of the system 400 is sized for setting in a first upper tubular string and the lower packing element 241 and the slip setting mechanism 410 are sized for setting in a second lower tubular string connected to and below the first tubular string, the second lower tubular string having an inner diameter less than that of the first upper tubular string.

The present invention, therefore, provides in some, but not necessarily all, embodiments a pack-off system for packing off an area of interest (in a wellbore and/or in a bore of an item in a wellbore) in a wellbore, the pack-off system having a body, two spaced-apart selectively settable packing elements on the body for sealing off the area of interest, selectively actuatable setting apparatus connected to the body for selectively setting the two spaced-apart selectively settable packing elements, the selectively actuatable setting apparatus actuatable by fluid introduced into the pack-off system at a desired rate of introduction. Such a system may have one or some (in any possible combination) of the following: release apparatus selectively actuatable by reducing the rate of introduction of fluid introduced to the pack-off system to selectively release the two spaced-apart selectively settable packing elements; the selectively actuatable setting apparatus further comprising at least two movable member apparatuses subject to force of the fluid introduced into the pack-off system, one each of the movable member apparatuses movable in response to the force of the fluid under pressure to contact one of the two spaced-apart selectively-settable packing elements to boost sealing of said elements for sealing off the area of interest; wherein the area of interest is an area adjacent a bore of a tubular string in the wellbore, the pack-off system is disposed in said bore, and the two spaced-apart selectively-settable packing elements are settable to seal off said bore; wherein the area of interest is within a bore of an item in the wellbore; a string to a lower end of which the pack-off system is connected, the string from the group consisting of coiled tubing, fiber optic line system, slick line, electrically conductive wireline, electrically non-conductive wireline, tubing, and casing; a system for straddling part of a bore in which the pack-off system is located, the pack-off system also having two spaced-apart pack-off mandrels, the two spaced-apart selectively-settable packing elements each on one of the spaced-apart pack-off mandrels, a tubular member with a portion within each pack-off mandrel, the tubular member selectively movable with respect to the pack-off mandrels, two spaced-apart setting sleeves secured to and movable with the tubular member, each setting sleeve movable to set one of the two spaced-apart selectively-settable packing elements, two spaced-apart latch apparatuses each latch apparatus connected to one of the spaced-apart pack-off mandrels for releasably holding the tubular member and two spaced-apart pack-off mandrels in a first position in which the two spaced-apart selectively-settable packing elements are not set, the tubular member having a fluid flow bore therethrough with a selectively closable lower end so that fluid pumped under pressure into the pack-off system and into the fluid flow bore of the tubular member moves the tubular member with respect to and apart from the two spaced-apart pack-off mandrels releasing the latch apparatus so that the setting sleeves move with the tubular member to set the two spaced-apart selectively settable packing elements against an interior of the bore in which the pack-off system is located; the body has at least one body flow port through which fluid is flowable from inside the pack-off system to the outside thereof, the release apparatus comprises a shut off sleeve movably mounted in the body and responsive to force of the fluid introduced under pressure into the wellbore and into the pack-off system, the shut-off sleeve having an orifice therethrough and a top-to-bottom fluid flow bore, flow through the orifice initially blocked by a portion of the body, a nozzle connected to the body, the nozzle having a fluid flow bore therethrough initially in fluid communication with the fluid flow bore of the shut-off sleeve, the nozzle having at least one exit port through which fluid can exit from the nozzle, a spring abutting the body and the shut-off sleeve and urging the shut-off sleeve upwardly so that initially the shut-off sleeve does not close off flow to the at least one exit port of the nozzle, the top-to-bottom fluid flow bore through the shut-off sleeve sized so that fluid under pressure is pumpable to the shut-off sleeve at a level sufficient to move the shut-off sleeve downwardly against force of the spring to align the orifice with the at least one body flow port and to close off flow to the at least one exit port of the nozzle so that fluid pressure builds up in the pack-off system and fluid under pressure exits from within the shut-off sleeve through the orifice and flows to the at least one body flow port and exits from the pack-off system; and/or wherein the two-spaced latch apparatuses are movable in response to the fluid under pressure to boost sealing of the area of interest by the two-spaced-apart selectively settable packing element.

The present invention, therefore, provides in some, but not necessarily all, embodiments a pack-off system for packing off an area of interest in a wellbore, the pack-off system having a body, two spaced-apart selectively settable packing elements on the body for sealing off the area of interest, selectively actuatable setting apparatus connected to the body for selectively setting the two spaced-apart selectively settable packing elements, the selectively actuatable setting apparatus actuatable by fluid under pressure introduced into the pack-off system, release apparatus selectively actuatable by reducing pressure of fluid pumped to the pack-off system to selectively release the two spaced-apart selectively settable packing elements, the selectively actuatable setting apparatus further comprising two movable member apparatuses subject to force of the fluid under pressure introduced into the pack-off system, one of the movable member apparatuses movable in response to the force of the fluid under pressure to contact each of the two spaced-apart selectively-settable packing elements to boost sealing of said elements for sealing off the area of interest, wherein the area of interest is an area adjacent a bore of a string in the wellbore, the pack-off system is disposed in said bore, and the two spaced-apart selectively-settable packing elements are settable to seal off said bore, and a string to a lower end of which the pack-off system is connected; such a system wherein the string from the group consisting of coiled tubing, fiber optic line system, slick line, electrically conductive wireline, electrically non-conductive wireline, tubing, and casing; and/or the body has at least one body flow port through which fluid is flowable from inside the pack-off system to the outside thereof, the release apparatus comprises a shut off sleeve movably mounted in the body and responsive to force of the fluid under pressure introduced into the wellbore and into the pack-off system, the shut-off sleeve having an orifice therethrough and a top-to-bottom fluid flow bore, flow through the orifice initially blocked by a portion of the body, a nozzle connected to the body, the nozzle having a fluid flow bore therethrough initially in fluid communication with the fluid flow bore of the shut-off sleeve, the nozzle having at least one exit port through which fluid can exit from the nozzle, a spring abutting the body and the shut-off sleeve and urging the shut-off sleeve upwardly so that initially the shutoff sleeve does not close off flow to the at least one exit port of the nozzle, the top-to-bottom fluid flow bore through the shut-off sleeve sized so that fluid under pressure is pumpable to the shutoff sleeve at a level sufficient to move the shut-off sleeve downwardly against force of the spring to align the orifice with the at least one body flow port and to close off flow to the at least one exit port of the nozzle so that fluid pressure builds up in the pack-off system and fluid under pressure exits from within the shut-off sleeve through the orifice and flows to the at least one body flow port and exits from the pack-off system.

The present invention, therefore, provides in some, but not necessarily all, embodiments a method for packing off an area of interest (in a wellbore or in an item in a wellbore) in a wellbore, the method including installing a pack-off system according to the present invention in the wellbore to pack-off the area of interest, and actuating the selectively actuatable setting apparatus to set each of the two spaced-apart selectively settable packing elements by introducing fluid to the pack-off system; such a method including actuating release apparatus by reducing rate of introduction of the fluid thereby releasing two spaced-apart selectively-settable packing elements; such a method including moving the pack-off system to another location within the wellbore and again setting two spaced-apart selectively settable packing elements; such a method including retrieving the pack-off system from the wellbore; such a method wherein the pack-off system includes movable member apparatus movable in response to fluid pressure for boosting sealing effects of two spaced-apart selectively settable packing elements, and the method includes boosting sealing effects of the two spaced-apart selectively settable packing elements; such a method wherein the pack-off system is connected to a lower end of a string, the string from the group consisting of coiled tubing, fiber optic line system, slick line, electrically conductive wireline, electrically non-conductive wireline, tubing and casing; such a method wherein the pack-off system has fluid exit apparatus for flowing fluid from within the pack-off system to an outside thereof, the method including flowing fluid from within the pack-off system to the outside thereof; such a method wherein the two spaced-apart selectively settable packing elements are set to pack-off a bore through an earth formation area of interest and wherein the fluid flowing from within the pack-off system to the outside thereof is formation treatment fluid that flows from the pack-off system, through any tubular (if any are present) in which the pack-off system is located, to the earth formation area of interest for treatment thereof; such a method wherein the fluid is pumped to the pack-off system from an earth surface pumping apparatus; and/or wherein the fluid flows to and/or is pumped to the pack-off system from an apparatus within the wellbore.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A pack-off system for packing off an area of interest in a wellbore, the pack-off system comprising a body, two spaced-apart selectively settable packing elements on the body for sealing off the area of interest, selectively actuatable setting apparatus connected to the body for selectively setting the two spaced-apart selectively settable packing elements, the selectively actuatable setting apparatus actuatable by fluid under pressure introduced into the pack-off system, release apparatus selectively actuatable by reducing pressure of fluid pumped to the pack-off system to selectively release the two spaced-apart selectively settable packing elements, the selectively actuatable setting apparatus further comprising two movable member apparatuses subject to force of the fluid under pressure introduced into the pack-off system, one of the movable member apparatuses movable in response to the force of the fluid under pressure to contact each of the two spaced-apart selectively-settable packing elements to boost sealing of said elements for sealing off the area of interest, wherein the area of interest is an area adjacent a bore of a string in the wellbore, the pack-off system is disposed in said bore, and the two spaced-apart selectively-settable packing elements are settable to seal off said bore, and a string to a lower end of which the pack-off system is connected.

2. The pack-off system of claim 1 further comprising the string from the group consisting of coiled tubing, fiber optic line system, slick line, electrically conductive wireline, electrically non-conductive wireline, tubing, and casing.

3. The pack-off system of claim 1 further comprising the body has at least one body flow port through which fluid is flowable from inside the pack-off system to the outside thereof, the release apparatus comprises a shut off sleeve movably mounted in the body and responsive to force of the fluid under pressure introduced into the wellbore and into the pack-off system, the shut-off sleeve having an orifice therethrough and a top-to-bottom fluid flow bore, flow through the orifice initially blocked by a portion of the body, a nozzle connected to the body, the nozzle having a fluid flow bore therethrough initially in fluid communication with the fluid flow bore of the shut-off sleeve, the nozzle having at least one exit port through which fluid can exit from the nozzle, a spring abutting the body and the shut-off sleeve and urging the shut-off sleeve upwardly so that initially the shut-off sleeve does not close off flow to the at least one exit port of the nozzle, the top-to-bottom fluid flow bore through the shutoff sleeve sized so that fluid under pressure is pumpable to the shut-off sleeve at a level sufficient to move the shut-off sleeve downwardly against force of the spring to align the orifice with the at least one body flow port and to close off flow to the at least one exit port of the nozzle so that fluid pressure builds up in the pack-off system and fluid under pressure exits from within the shut-off sleeve through the orifice and flows to the at least one body flow port and exits from the pack-off system.

4. A pack-off system for packing off an area of interest in a wellbore, the pack-off system comprising a body, two spaced-apart selectively settable packing elements on the body for sealing off the area of interest, selectively actuatable setting apparatus connected to the body for selectively setting the two spaced-apart selectively settable packing elements, the selectively actuatable setting apparatus actuatable by fluid introduced into the pack-off system at a desired rate of introduction, and release apparatus selectively actuatable by reducing the rate of introduction of fluid introduced to the pack-off system to selectively release the two spaced-apart selectively settable packing elements.

5. The pack-off system of claim 4 wherein the selectively actuatable setting apparatus further comprising at least two movable member apparatuses subject to force of the fluid introduced into the pack-off system, one each of the movable member apparatuses movable in response to the force of the fluid under pressure to contact one of the two spaced-apart selectively-settable packing elements to boost sealing of said elements for sealing off the area of interest.

6. The pack-off system of claim 4 wherein the area of interest is an area adjacent a bore of a tubular string in the wellbore, the pack-off system is disposed in said bore, and the two spaced-apart selectively-settable packing elements are settable to seal off said bore.

7. The pack-off system of claim 4 wherein the area of interest is within a bore of an item in the wellbore.

8. The pack-off system of claim 4 further comprising a string to a lower end of which the pack-off system is connected, the string from the group consisting of coiled tubing, fiber optic line system, slick line, electrically conductive wireline, electrically non-conductive wireline, tubing, and casing.

9. The pack-off system of claim 4, said pack-off system for straddling part of a bore in which the pack-off system is located, the pack-off system further comprising two spaced-apart pack-off mandrels, the two spaced-apart selectively-settable packing elements each on one of the spaced-apart pack-off mandrels, a tubular member with a portion within each pack-off mandrel, the tubular member selectively movable with respect to the pack-off mandrels, two spaced-apart setting sleeves secured to and movable with the tubular member, each setting sleeve movable to set one of the two spaced-apart selectively-settable packing elements, two spaced-apart latch apparatuses each latch apparatus connected to one of the spaced-apart pack-off mandrels for releasably holding the tubular member and two spaced-apart pack-off mandrels in a first position in which the two spaced-apart selectively-settable packing elements are not set, the tubular member having a fluid flow bore therethrough with a selectively closable lower end so that fluid pumped under pressure into the pack-off system and into the fluid flow bore of the tubular member moves the tubular member with respect to and apart from the two spaced-apart pack-off mandrels releasing the latch apparatus so that the setting sleeves move with the tubular member to set the two spaced-apart selectively settable packing elements against an interior of the bore in which the pack-off system is located.

10. The pack-off system of claim 9 wherein the two-spaced latch apparatuses are movable in response to the fluid under pressure to boost sealing of the area of interest by the two-spaced-apart selectively settable packing element.

11. The pack-off system of claim 4 wherein the body has at least one body flow port through which fluid is flowable from inside the pack-off system to the outside thereof, the release apparatus comprises a shut off sleeve movably mounted in the body and responsive to force of the fluid introduced under pressure into the wellbore and into the pack-off system, the shut-off sleeve having an orifice therethrough and a top-to-bottom fluid flow bore, flow through the orifice initially blocked by a portion of the body, a nozzle connected to the body, the nozzle having a fluid flow bore therethrough initially in fluid communication with the fluid flow bore of the shutoff sleeve, the nozzle having at least one exit port through which fluid can exit from the nozzle, a spring abutting the body and the shut-off sleeve and urging the shut-off sleeve upwardly so that initially the shut-off sleeve does not close off flow to the at least one exit port of the nozzle, the top-to-bottom fluid flow bore through the shut-off sleeve sized so that fluid under pressure is pumpable to the shut-off sleeve at a level sufficient to move the shut-off sleeve downwardly against force of the spring to align the orifice with the at least one body flow port and to close off flow to the at least one exit port of the nozzle so that fluid pressure builds up in the pack-off system and fluid under pressure exits from within the shut-off sleeve through the orifice and flows to the at least one body flow port and exits from the pack-off system.

12. A pack-off system for packing off an area of interest in a wellbore, the pack-off system comprising a body, two spaced-apart selectively settable packing elements on the body for sealing off the area of interest, selectively actuatable setting apparatus connected to the body for selectively setting the two spaced-apart selectively settable packing elements, the selectively actuatable setting apparatus actuatable by fluid introduced into the pack-off system at a desired rate of introduction, and at least two movable member apparatuses subject to force of the fluid introduced into the pack-off system, and one each of the movable member apparatuses movable in response to the force of the fluid under pressure to contact one of the two spaced-apart selectively-settable packing elements to boost sealing of said elements for sealing off the area of interest.

13. A method for packing off an area of interest in a wellbore, the method comprising installing a pack-off system in the wellbore to pack-off the area of interest, the pack-off system comprising a body, two spaced-apart selectively settable packing elements on the body for sealing off the area of interest, selectively actuatable setting apparatus connected to the body for selectively setting the two spaced-apart selectively settable packing elements, the selectively actuatable setting apparatus actuatable by fluid introduced into the pack-off system at a desired rate of introduction, actuating the selectively actuatable setting apparatus to set each of the two spaced-apart selectively settable packing elements by introducing fluid to the pack-off system, wherein the pack-off system further comprises release apparatus selectively actuatable by reducing the rate of introduction of fluid introduced to the pack-off system to selectively release the two spaced-apart selectively settable packing elements, and the method further comprises actuating the release apparatus by reducing rate of introduction of the fluid thereby releasing the two spaced-apart selectively-settable packing elements.

14. The method of claim 13 further comprising moving the pack-off system to another location within the wellbore and again setting the two spaced-apart selectively settable packing elements.

15. The method of claim 13 further comprising retrieving the pack-off system from the wellbore.

16. The method of claim 13 wherein the pack-off system includes movable member apparatus movable in response to fluid pressure for boosting sealing effects of the two spaced-apart selectively settable packing elements, the method further comprising boosting sealing effects of the two spaced-apart selectively settable packing elements.

17. The method of claim 13 wherein the area of interest is an area adjacent a bore of a tubular string in the wellbore, the pack-off system is disposed in said bore, and the two spaced-apart selectively-settable packing elements are settable to seal off said bore.

18. The method of claim 13 wherein the area of interest is within a bore of an item in the wellbore.

19. The method of claim 13 wherein the pack-off system is connected to a lower end of a string, the string from the group consisting of coiled tubing, fiber optic line system, slick line, electrically conductive wireline, electrically non-conductive wireline, tubing and casing.

20. The method of claim 13 wherein the pack-off system has fluid exit apparatus for flowing fluid from within the pack-off system to an outside thereof, the method further comprising flowing fluid from within the pack-off system to the outside thereof.

21. The method of claim 20 wherein the two spaced-apart selectively settable packing elements are set to pack-off a bore through an earth formation area of interest and wherein the fluid flowing from within the pack-off system to the outside thereof is formation treatment fluid that flows from the pack-off system, through any tubular in which the pack-off system is located, to the earth formation area of interest for treatment thereof.

22. The method of claim 13 wherein the fluid is pumped to the pack-off system from an earth surface pumping apparatus.

23. The method of claim 13 wherein the fluid is pumped to the pack-off system from an apparatus within the well-bore.

* * * * *